US005358632A

United States Patent [19]

Hedrick

[11] Patent Number: 5,358,632

[45] Date of Patent: Oct. 25, 1994

[54] FCC FEED INJECTION WITH NON-QUIESCENT MIXING

[75] Inventor: Brian W. Hedrick, Rolling Meadows, Ill.

[73] Assignee: UOP, Des Plaines, Ill.

[21] Appl. No.: 92,635

[22] Filed: Jul. 16, 1993

[51] Int. Cl.[5] ..... C10G 11/18; C10G 35/14

[52] U.S. Cl. ..... 208/163; 208/113; 208/164

[58] Field of Search ..... 208/113, 157, 127, 164, 208/153, 155, 158, 120, 163; 422/140

[56] References Cited

U.S. PATENT DOCUMENTS

| | | | |
|---|---|---|---|
| 3,071,540 | 1/1963 | McMahon et al. | 208/163 |
| 3,261,776 | 7/1966 | Baumann et al. | 208/113 |
| 4,427,537 | 1/1984 | Dean et al. | 208/120 |
| 4,427,538 | 1/1984 | Bartholic | 208/127 |
| 4,427,539 | 1/1984 | Busch et al. | 208/127 |
| 4,434,049 | 2/1984 | Dean et al. | 208/153 |
| 4,479,870 | 10/1984 | Hammershaimb et al. | 208/164 |
| 4,717,467 | 1/1988 | Haddad et al. | 208/113 |
| 5,139,748 | 8/1992 | Lomas et al. | 422/140 |

*Primary Examiner*—Asok Pal

*Assistant Examiner*—Bekir L. Yildirim

*Attorney, Agent, or Firm*—Thomas K. McBride; John G. Tolomei

[57] ABSTRACT

An FCC feed distributor mixes fresh catalyst entering the riser with steam to create a dense bubbling bed of catalyst. Fluidized catalyst rises from the dense bed around a conical section supported from the bottom of the riser. The conical section accelerates the catalyst by reducing the flow area into a small width annulus. As fast fluidized catalyst flows to the annulus, a ring of small diameter nozzles shoot feed across the narrow annular gap into the moving catalyst. The narrow gap provides good penetration of the catalyst stream to completely mix the catalyst and feed. A gently tapered conical section above the annular gap provides an extended region of gradually increasing flow area that controls downstream acceleration of the gas and catalyst mixture by permitting expansion and preventing back mixing over the initial stages of the cracking reaction. This arrangement improves the uniformity of gas and catalyst contacting while reducing the amount of steam or other dispersion gas required to achieve good catalyst and feed contact.

12 Claims, 1 Drawing Sheet

FCC FEED INJECTION WITH NON-QUIESCENT MIXING

BACKGROUND OF THE INVENTION

1. Field of the Invention

This invention relates generally to the dispersing of liquids into fluidized solids. More specifically this invention relates to a method and apparatus for dispersing a hydrocarbon feed into a stream of fluidized catalyst particles.

2. Description of the Prior Art

There are a number of continuous cyclical processes employing fluidized solid techniques in which carbonaceous materials are deposited on the solids in the reaction zone and the solids are conveyed during the course of the cycle to another zone where carbon deposits are at least partially removed by combustion in an oxygen-containing medium. The solids from the latter zone are subsequently withdrawn and reintroduced in whole or in part to the reaction zone.

One of the more important processes of this nature is the fluid catalytic cracking (FCC) process for the conversion of relatively high-boiling hydrocarbons to lighter hydrocarbons boiling in the heating oil or gasoline (or lighter) range. The hydrocarbon feed is contacted in one or more reaction zones with the particulate cracking catalyst maintained in a fluidized state under conditions suitable for the conversion of hydrocarbons.

It has been found that the method of contacting the feedstock with the catalyst can dramatically affect the performance of the reaction zone. Ideally the feed is instantaneously dispersed as it enters the riser over the entire cross-section of a stream of catalyst that is moving up the riser. A complete and instantaneous dispersal of feed across the entire cross section of the riser is not possible, but good results have been obtained by injecting a highly atomized feed into a pre-accelerated stream of catalyst particles. However, the dispersing of the feed throughout the catalyst particles takes some time, so that there is some non-uniform contact between the feed and catalyst as previously described. Non-uniform contacting of the feed and the catalyst, for the time it is in the axial contact zone, exposes portions of the feed to the catalyst for longer periods of time which can in turn produce overcracking and reduce the quality of reaction products.

It has been a long recognized objective in the FCC process to maximize the dispersal of the hydrocarbon feed into the particulate catalyst suspension. Dividing the feed into small droplets improves dispersion of the feed by increasing the interaction between the liquid and solid. Preferably, in hydrocarbon conversion droplet sizes become small enough to permit vaporization of the liquid before it contacts the solids.

It is well known that agitation or shearing can atomize a liquid hydrocarbon feed into fine droplets which are then directed at the fluidized solid particles. A variety of methods are known for shearing such liquid streams into fine droplets.

U.S. Pat. No. 3,071,540 discloses a feed injection apparatus for a fluid catalytic cracking unit wherein a high velocity stream of gas, in this case steam, converges around the stream of oil upstream of an orifice through which the mixture of steam and oil is discharged. Initial impact of the steam with the oil stream and subsequent discharge through the orifice atomizes the liquid oil into a dispersion of fine droplets which contact a stream of coaxially flowing catalyst particles.

U.S. Pat. No. 4,434,049 shows a device for injecting a fine dispersion of oil droplets into a fluidized catalyst stream wherein the oil is first discharged through an orifice onto an impact surface located within a mixing tube. The mixing tube delivers a cross flow of steam which simultaneously contacts the liquid. The combined flow of oil and steam exits the conduit through an orifice which atomizes the feed into a dispersion of fine droplets and directs the dispersion into a stream of flowing catalyst particles.

The injection devices of the '540 and '049 patents rely on relatively high fluid velocities and pressure drops to achieve atomization of the oil into fine droplets. Providing this higher pressure drop burdens the design and increases the cost of equipment such as pumps and exchangers that are typically used to supply liquid and gas to the feed injection device. The need to replace such equipment may greatly increase the cost of retrofitting an existing liquid-solid contacting installation with such an injection apparatus.

U.S. Pat. No. 4,717,467 shows a method for injecting an FCC feed into an FCC riser from a plurality of discharge points. The discharge points in the '467 patent do not radially discharge the feed mixture into the riser.

Another useful feature for dispersing feed in FCC units is the use of a lift gas to pre-accelerate the catalyst particles before contact with the feed. Modern FCC units use a pipe reactor in the form of a large, usually vertical, riser in which a gaseous medium upwardly transports the catalyst in a fluidized state. Catalyst particles first enter the riser with zero velocity in the ultimate direction of riser flow. Initiating or changing the direction of particle flow creates turbulent conditions at the bottom of the riser. When feed is introduced into the bottom of the riser the turbulence can cause real-distribution and variations in the contact time between the catalyst and the feed. In order to obtain a more uniform dispersion, the catalyst particles are first contacted with a lift gas to initiate upward movement of the catalyst. The lift gas creates a catalyst pre-acceleration zone that moves the catalyst along the riser before it contacts the feed. After the catalyst is moving up the riser it is contacted with the feed by injecting the feed into a downstream section of the riser. Injecting the feed into a flowing stream of catalyst avoids the turbulence and backmixing of particles and feed that occurs when the feed contacts the catalyst in the bottom of the riser. A good example of the use of lift gas in an FCC riser can be found in U.S. Pat. No. 4,479,870 issued to Hammershaimb and Lomas.

There are additional references which show use of a lift gas in noncatalytic systems. For example, in U.S. Pat. No. 4,427,538 to Bartholic, a gas which may be a light hydrocarbon is mixed with an inert solid at the bottom part of a vertical confined conduit and a heavy petroleum fraction is introduced at a point downstream so as to vary the residence time of the petroleum fraction in the conduit. Similarly, in U.S. Pat. No. 4,427,539 to Busch et al., a $C_4$ minus gas is used to accompany particles of little activity up a riser upstream of charged residual oil so as to aid in dispersing the oil.

U.S. Pat. No. 5,139,748 issued to Lomas et al. shows the use of radially directed feed injection nozzles to introduce feed into an FCC riser. The nozzles are arranged in a circumferential band about the riser and inject feed toward the center of the riser. The nozzle arrangement and geometry of the riser maintains a substantially open riser cross-section over the feed injection and downstream riser sections.

Feed atomization, lift-gas and radial injection of feed have been used to more uniformly disperse feed over the cross-section of a riser reaction zone. Nevertheless, as feed contacts the hot catalyst, cracking and volumetric expansion of the hydrocarbons causes an increase in the volumetric rate of fluids passing up the riser. A large portion of this volumetric increase occurs immediately downstream of the feed injection point. Previous feed distributors have allowed this volumetric expansion to occur in a relatively uncontrolled fashion. The uncontrolled volumetric expansion occurring simultaneously with mixing of catalyst and hydrocarbon feed results in real-distribution that adversely effects the quantity and quality of the products obtained from the cracking reaction. This maldistribution is caused by turbulent back mixing as well as quiescent zones in the riser section immediately downstream of the feed injection point.

SUMMARY OF THE INVENTION

It is an object of this invention to provide a method and apparatus for reducing or eliminating non-uniformity in the mixing of catalyst and feed and quiescent flow regions downstream of the feed injection to an FCC riser conduit.

It is a further objection of this invention to reduce or eliminate turbulence downstream of the feed injection point of an FCC that uses a conduit type reaction zone.

This objective is achieved by the use of a FCC feed distributor that mixes fresh catalyst entering a reaction conduit with a fluidizing medium to create a dense bubbling bed of catalyst and radially discharges feed hydrocarbons from a central feed distributor into a feed contact zone and passes the feed into a zone of continuously increasing cross-sectional diameter to eliminate or reduce quiescent or turbulent zones by providing an acceleration zone with a more uniform flow of catalyst and feed. The method and apparatus of this invention keep the velocity of the mixing catalyst and hydrocarbons more or less constant after the initial acceleration. A more constant velocity allows the reactant to expand into the full riser without creating the low velocity areas, i.e. quiescent areas which could result in back mixing of the catalyst and oil. In order to achieve good initial distribution the method an apparatus of this invention feeds a low velocity fluidized bed of catalyst to a feed contact zone. The feed contact zone radially discharges hydrocarbons across a feed contact zone having a narrow width and a reduced cross-sectional area that provides good initial mixing of the catalyst and hydrocarbons. Catalyst accelerates upwardly as the flowing cross-sectional area for the feed and catalyst increases to accommodate a volumetric expansion of the feed. In this manner the invention achieves good catalyst and feed mixing without large volumes of atomizing steam or large quantities of lift-gas to preaccelerate the catalyst. These benefits are in addition to preventing the back mixing of catalyst or oil in the conduit downstream of the feed injection point.

Accordingly, in a specific embodiment, this invention is a method of mixing fluidized particles with a fluid feedstream comprising hydrocarbons. The method combines fluidized particles and a fluidizing medium in an upstream section of a conduit to produce a dense bed of catalyst. The dense bed of catalyst passes downstream along the conduit into a feed contact zone that has a reduced cross-sectional area relative to the upstream section. The feed contact zone discharges a fluid stream radially into the feed to produce a mixture of feed and catalyst. The mixture of feed and catalyst accelerates downstream into an acceleration zone having a continuously increasing cross-sectional area. After a residence time of at least 0.05 seconds, the mixture of feed and catalyst passes from the acceleration zone into a downstream section of the conduit that has a uniform cross-sectional area.

Another embodiment of this invention is an apparatus for contacting FCC catalyst with an FCC feedstock. The apparatus includes an elongated riser conduit having an upstream and downstream end, and means for adding the FCC catalyst to the upstream end of the riser conduit, and means for distributing a fluidizing medium to the upstream end of the riser to create a dense catalyst bed. A central distributor located in the center of the riser conduit, at a location downstream of means for adding catalyst to the riser conduit, forms an annular feed distribution space between the interior of the riser and the exterior of the distributor. The distributor also defines a plurality of outwardly directed feed injection orifices for radially discharging feed into the annular distribution space. Means located downstream of the feed injection orifices continuously increases the cross-section of the riser conduit from that provided by the annular feed distribution space to the full cross-section of the conduit.

Additional objects, embodiments and details of this invention can be obtained from the following detailed description.

DETAILED DESCRIPTION OF THE INVENTION

This invention will be described in the context of an FCC process for the catalytic cracking of hydrocarbons by contact with a fluidized catalyst.

Figure 1:
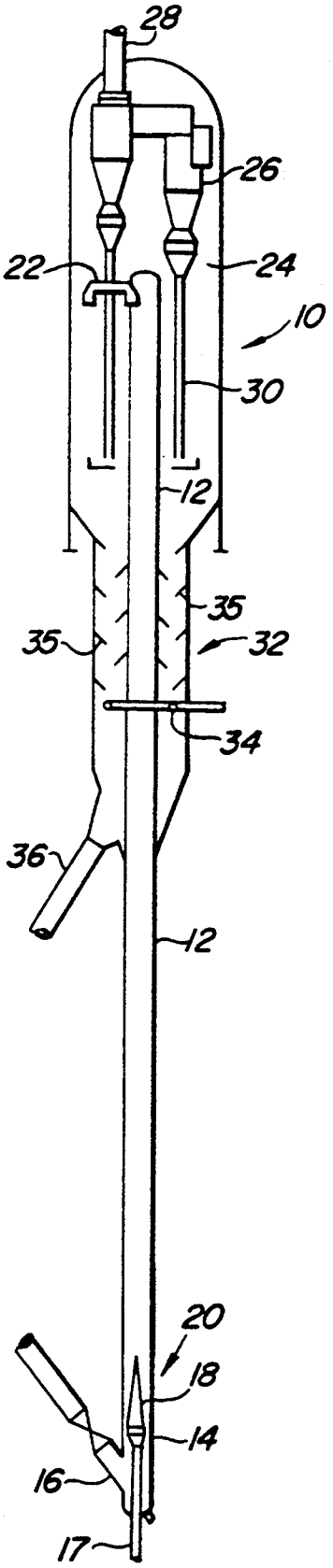
FIG. 1 is a sectional elevation of an FCC reactor and riser.

In a typical FCC process flow, finely divided regenerated catalyst leaves a regeneration zone and contacts a feedstock in a lower portion of a reactor riser zone. FIG. 1 shows a reactor 10 with a vertical riser 20 having an upper section 12 and a lower riser portion 14 into which a regenerator standpipe 16 transfers catalyst from the regenerator (not shown). Feed enters the riser through conduit 17 and a feed distributor 18. While the resulting mixture, which has a temperature of from about 200° C. to about 700° C., passes up through the riser, conversion of the feed to lighter products occurs and coke is deposited on the catalyst. The effluent from the riser is discharged from the top of the riser through a disengaging arm 22 into a disengaging space 24 where additional conversion can take place. The hydrocarbon vapors, containing entrained catalyst, are then passed through one or more cyclone separators 26 to separate any spent catalyst from the hydrocarbon vapor stream. The separated hydrocarbon vapor stream is passed from an outlet nozzle 28 into a fractionalion zone (not shown) known in the art as the main column wherein the hydrocarbon effluent is separated into such typical fractions as light gases and gasoline, light cycle oil, heavy cycle oil and slurry oil. Various fractions from the main column can be recycled along with the feedstock to the reactor riser. Typically, fractions such as light gases and gasoline are further separated and processed in a gas concentration process located downstream of the main column. Some of the fractions from the main column, as well as those recovered from the gas concentration process may be recovered as final product streams. The separated spent catalyst from cyclones 26 passes into the lower portion of the disengaging space through dip legs 30 and eventually leaves that zone passing through a stripping zone 32 in which a stripping gas, usually steam, enters a lower portion of zone 32 through a distributor ring 34 and contacts the spent catalyst purging adsorbed and interstitial hydrocarbons from the catalyst. A series of baffles 35 in the stripping zone improves contact between the catalyst and stripping gas. The spent catalyst containing coke leaves the stripping zone through a reactor conduit 36 and passes into the regeneration zone where, in the presence of fresh regeneration gas and at a temperature of from about 620° C. to about 760° C., combustion of coke produces regenerated catalyst and flue gas containing carbon monoxide, carbon dioxide, water; nitrogen and perhaps a small quantity of oxygen. Usually, the fresh regeneration gas is air, but it could be air enriched or deficient in oxygen. Flue gas is separated from entrained regenerated catalyst by cyclone separation means located within the regeneration zone and separated flue gas is passed from the regeneration zone, typically, to a carbon monoxide boiler where the chemical heat of carbon monoxide is recovered by combustion as a fuel for the production of steam, or, if carbon monoxide combustion in the regeneration zone is complete, the flue gas passes directly to sensible heat recovery means and from there to a refinery stack. Regenerated catalyst which was separated from the flue gas is returned to the lower portion of the regeneration zone which typically is maintained at a higher catalyst density. A stream of regenerated catalyst leaves the regeneration zone, and as previously mentioned, contacts the feedstock in the reaction zone.

Catalysts that can be used in this process include those known to the art as fluidized catalytic cracking catalysts. Specifically, the high activity crystalline aluminosilicate or zeolite-containing catalysts can be used and are preferred because of their higher resistance to the deactivating effects of high temperatures, exposure to steam, and exposure to metals contained in the feedstock. Zeolites are the most commonly used crystalline aluminosilicates in FCC.

Figure 2:
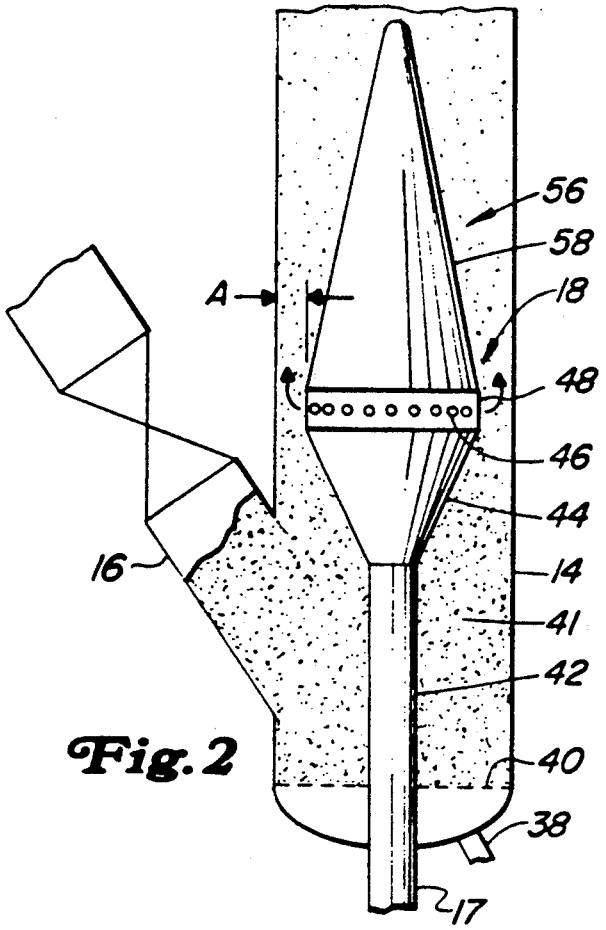
FIG. 2 is an enlarged section of the lower end of the riser shown in FIG. 1.

Catalyst entering the lower section 14 of the riser conduit first forms a dense catalyst bed. FIG. 2 more clearly shows the detail of the bottom section 14 of the riser conduit. A fluidizing medium enters the bottom of the riser through a line 38 and 25 contacts the catalyst entering through line 16 to form a dense bed 41. The term dense bed refers to a region of catalyst having a density of at least 20 pounds per cubic foot. In order to increase the uniformity of the dense bed the fluidizing medium passes through a distribution plate 40 before contacting the catalyst. The dense bed zone is also termed a bubbling bed which provides good mixing of the catalyst and a uniform suspension of catalyst around a pipe portion 42 and a cone portion 44 of the central distributor 18. The quantity of fluidizing gas entering the bottom of the riser creates a low upward velocity of catalyst having a velocity of less than 6 feet per second and usually in a range of from 3 to 5 feet per second.

This invention does not require a specific gas composition for the fluidizing medium. Steam can serve as a suitable fluidizing medium. The fluidizing medium can also comprise a typical lift gas and can be used by itself or in combination with steam. Lift gas typically includes not more than 10 mol % of $C_3$ and heavier hydrocarbons. In addition to hydrocarbons, other reaction species may be present in or comprise the fluidizing mediums such as $H_2$, $H_2S$, $N_2$, CO and/or $CO_2$.

Whatever type of fluidizing medium is used in the dense bed the low gas velocity through the dense bed zone requires very little fluidizing medium. Thus, in addition to the dense bed conditions providing good mixing of the catalyst and distribution of the catalyst around cone 44, it also minimizes the amount of fluidizing medium needed prior to the injection of the feed. Preferably the gas velocity through the bed is kept very low, in most cases at a rate of 2 feet per second or less. In the case of steam, the fluidizing medium will range between 0.2 and 0.5 wt %. Such low fluidizing medium rates represent a ten fold decrease over that currently used in feed distributors. Nevertheless, low gas flow is sufficient to maintain the dense bubbling bed conditions throughout the volume of catalyst located below the band 48 of feed injection orifices 46.

An essential element of this invention is the geometry of the catalyst flow path just ahead of the feed contact zone and the geometry of the feed and catalyst contact zone. As the catalyst passes upwardly in the dense bed, cone 44 reduces the cross-sectional area of the riser and increases the velocity of the catalyst before it contacts the feed. Cone 44 channels the feed into an annular opening having a small width. A small diameter or small width opening is another essential feature of this invention. FIG. 2 shows cone 44 channeling the catalyst into a narrow annular feed contact zone. A possible, but less effective arrangement of this invention would channel all the flow into a central orifice having a small diameter. Whether practiced with an annular feed contact zone or a central orifice, the transverse width or diameter of the feed and catalyst contact zone is carefully controlled. The width of an annular feed and catalyst contact zone is shown by dimension "A" in FIG. 2. Preferably this zone will have a width of less than 8 inches and more preferably a width of less than 6 inches. The narrow transverse width of the feed catalyst contact zone insures good contact of the feed with the catalyst by allowing the feed to penetrate all or substantially all of the transverse width of the feed and catalyst contact zone. Rapid and thorough mixing between the feed and catalyst is also promoted by the use of numerous small diameter orifice openings, 46 around the periphery band of 48. The orifice openings are sized to provide a gas velocity in a range of from 6 to 20 feet per second out of the orifice openings. The preferred pattern for the orifice opening 46 uses $\frac{1}{4}$ inch openings on about 1 inch centers. The selection of width "A" is dependent upon the pressure drop and size of the orifice openings selected in distribution band 48. Typically, in the case of $\frac{1}{4}$ inch openings, the number of opening is selected to provide a velocity of oil through the holes of about 10 feet per second. Where necessary the holes may be staggered or provided in multiple rows to increase the number of holes. Small holes are preferred since it maximizes the number of openings and provides a greater continuous flow area about the circumference of band 48. Those skilled in the art can size different combinations of openings and width "A" that can provide good feed contact across the entire transverse width of the feed and catalyst contact zone. Such other arrangements include narrow slots over the circumference of band "A" and variations in the diameter of orifice opening 46 to change the length of the jets emanating from the orifices to distribute feed to the inner and outer portions of width "A". The narrow width is particularly effective since it requires only a small opening to provide a sufficient jet to penetrate across the entire width "A" and the use of small orifice opening in turn maximizes their number to approximate continuous oil injection over the entire circumference of band 48.

The use of the small width feed contact area and the numerous small diameter orifices will eliminate the need for many of prior art methods of obtaining good feed distribution. The prior art methods include use of an expanding gas or gaseous component such as steam in conjunction with another source of energy in order to break up the liquid. This other source of energy can consist of a high pressure drop for the gas and liquid mixture. This supply of additional energy makes up for inadequate mixing so that a fine and uniform distribution of droplets will still be obtained outside the orifice opening. It is also known that the pressure drop across an orifice can be reduced while still obtaining a good dispersion of fine liquid droplets by blending and homogenizing the liquid and any added gas sequentially in stages of increased mixing severity. The small orifice openings as taught by this invention are effective to disperse the feed into small droplets. The dispersion of the feed into yet finer droplets is promoted by imparting sufficient energy into the liquid. Where desired any of these prior art methods may be used in combination with the feed injection arrangement of this invention. In most cases this invention will be practiced with some addition of steam to the feed before discharge through the orifices. The feed entering the distribution device will usually have a temperature below its initial boiling point but a temperature above the boiling point of any steam or gaseous hydrocarbons that enter the distribution device along with the liquid. A minimum quantity of gaseous material equal to about 0.2 wt.% of the combined liquid and gaseous mixture, is typically cornmingled with the liquid entering the distribution device. As any gaseous medium and liquid, usually steam and hydrocarbons, enter the distribution device, they tend to remain segregated. Therefore, this invention may benefit from passing the mixture through a mixing device such as one or more baffles to blend the hydrocarbon and any gas into a relatively uniform hydrocarbon and gas stream. By substantially uniform, it is meant that any major segregation between the liquid and gaseous component that would tend to deliver more liquid or gaseous medium to one section or another of the orifice is eliminated. This blending is typically mild and normally will add a pressure drop of less than 20 psi to the system.

The angle at which the centerlines of the orifices are aimed is an important element of this invention. It is essential that the orifices impart a primarily radial velocity to the exiting feed. For this reason, the centerlines of the orifices make approximately a right angle with the centerline of the riser. It is not necessary that the orifice centerlines be kept completely perpendicular to the centerline of the riser. The centerlines may deviate by an angle of 25° with a plane perpendicular to the centerline of the riser. But preferably the angle of the orifice centerlines deviate from such plane by an angle of less than 10° and more preferably less than 5°.

The design of the nozzle end or orifice opening can also contribute to the effective functioning of this invention. Production of a relatively small spray pattern from the end of the nozzle aids in dispersing feed mixture across the entire cross-section of the narrow diameter feed and catalyst contact zone. Therefore, the ends of the nozzle have a restricted discharge opening in the form of a nozzle or slot that will spray the feed in a narrow pattern. Preferably, the total angle of this pattern in the vertical direction does not exceed 45° and more preferably it does not exceed 20°. When nozzles are used to enhance a spray pattern they are preferably located flush to the surface of circumferential band 48.

It is possible to form the orifice openings in a number of ways. The simplest way of forming the opening is by simply punching holes into the plates used to distribute the feed. Alternately, the orifice openings may be defined by nozzles welded into or onto the central feed distributor and any other location from which feed is injected. A flush location for the orifices or nozzles minimizes the possibility of flowing catalyst producing erosion on these elements. In general flow induced catalyst erosion should not pose significant problems for the arrangement of this invention. The small size of the orifice openings and the low jet velocity of the feed distributor reduce the strength of any jet produced thereby and thus minimizes the potential for erosion. As an extra safeguard to protect the metal wall of the riser from possible erosion, a band of high density abrasion-resistant lining can be located on the inside of the riser wall above top over area across from band 48. Compositions and methods for installing abrasion-resistant linings are well known to those skilled in the art of FCC piping designs. When used such linings will preferably have a thickness of at least 75 mm and will extend axially along the riser wall for a distance equal to at least one riser diameter.

Figure 3:
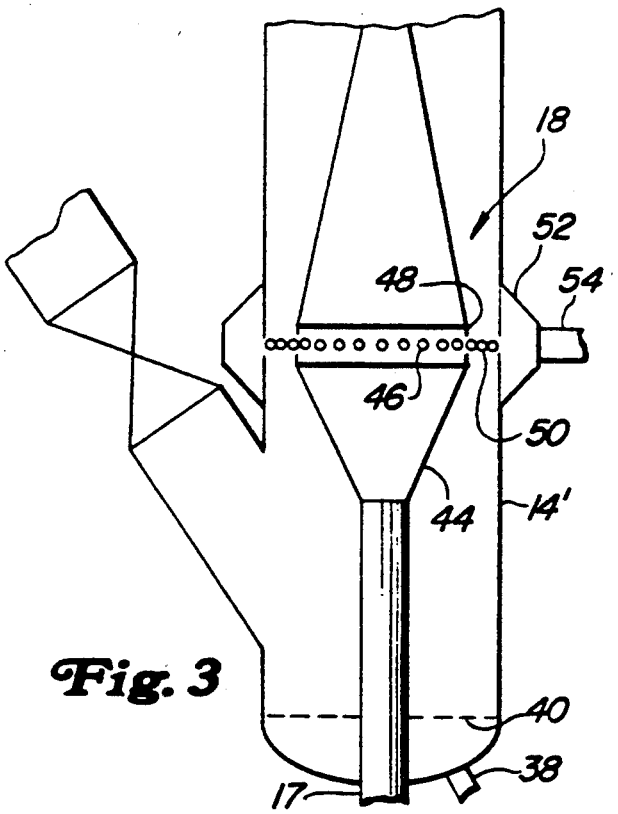
FIG. 3 is a modified section of the lower end of the riser shown in FIG. 1.

FIG. 3 shows an alternate arrangement that further increases the contacting of feed across an annular feed and contact zone. In addition to orifice openings 46 provided in the central distributor, a band of orifice openings at the same elevation located along the conduit 14 circles the inside of a riser 14' and injects feed radially toward the central distributor 18. In this arrangement the portion of feed entering the reaction conduit is split between conduit 17 and a conduit 54. Conduit 54 supplies the portion of the feed diverted from conduit 17 into a manifold 52. Manifold 52 extends circumferentially around the riser to deliver feed to the orifice openings 50. The injection of feed from two directions across the transverse width of the feed and catalyst contact zone may be used in different ways. Injection of feed from two directions can be used to increase the overall width of the contact zone while yet achieving excellent feed and catalyst contacting. Alternately, the additional inwardly directed feed injection may be used to reduce the size of the openings and provide a yet more continuous circumferential band of transverse feed injection from both the central distributor 18 and the outer feed injection orifices 50.

Following mixing, contact of the feed with the hot catalyst creates a volumetric expansion from both the vaporization of liquid hydrocarbons and heating of the vapor as well as cracking of the hydrocarbons into lower molecular weight species. An important element of this invention is controlling the flowing cross-sectional area of the feed and catalyst downstream of the catalyst and feed mixing zone. This control provides a gradual and continuous increase in the flowing cross-section area for the catalyst and feed mixture. Gradually increasing the flowing cross-sectional area prevents abrupt changes in the velocity of the stream and the resulting turbulence or quiescent zones that introduces variations in the feed and catalyst contact time thereby preventing uniform catalyst and feed contacting.

Referring again to FIG. 2, the zone immediately downstream in the feed and catalyst contacting is indicated by numeral 56 in FIG. 2 and termed an "acceleration zone". The term "acceleration zone" refers to the function of this zone to control the acceleration of the catalyst with the objective of providing a more constant velocity of the catalyst and feed mixture through the acceleration zone. The acceleration zone passes the catalyst and feed mixture into a section of the downstream conduit or riser having a uniform cross-section. A uniform cross-sectional area for the conduit downstream of the acceleration zone comprises at least a short section of riser wherein the cross-section area does not significantly change.

Suitable geometries for the acceleration zone will provide tapered sections that continuously increase the cross-section of the catalyst and feed mixture from the minimum diameter of the catalyst feed contact zone to the full diameter of the riser. The tapered sections should provide a smooth profile without any abrupt discontinuities that would promote turbulence or quiescent regions in the acceleration zone. Nevertheless the tapered sections may provide a linearly or non-linearly increasing flow area. However, a linearly increasing flow area is believed to most effectively to control the acceleration of the gas and catalyst stream through the acceleration zone.

The acceleration zone has a length that will provide sufficient residence time for the expansion of gases to stabilize. A minimum residence time of about 0.05 seconds is required in the acceleration zone. Preferably the acceleration zone will provide a residence time for the catalyst and gas mixture of from 0.05 to 0.2 seconds Preferably the feed and catalyst mixture will flow through the acceleration zone and into the full riser diameter approximately 0.1 to 0.15 seconds after feed injection. The acceleration zone must also be sized to accommodate substantial gas and catalyst flow velocities through the acceleration zone. As the catalyst leaves the restrictive flow area of the feed and catalyst contact zone, it is immediately accelerated to about 35 to 40 feet per second as the reaction begins. Catalyst and gas velocity through the acceleration zone will usually range from 40 to 65 feet per second. Applying these criteria to most reaction conduits, the acceleration zone will have a length of from 3 to 8 feet.

FIG. 2 depicts one form of the acceleration zone of this invention. In the embodiment of FIG. 2, a cone 58 fixed to the downstream end of band 48 defines the inner surface of the acceleration zone and the inside wall of reaction conduit 14 defines the outer surface of the acceleration zone. The cone provides a linear increase in the flowing cross-sectional area of there reaction conduit which is proportional to the distance downstream from the feed injection point. In order to provide a gradual increase in the flowing cross-sectional area the cone will have a slope of at least $\frac{1}{4}$. At the end of cone 58, the stream of catalyst and feed flows into the entire cross-section of riser 14. By the time the feed and catalyst mixture has reached the end of cone 58, the velocity of the feed is stabilized in a range of from 40 to 80 feet per second. Although additional expansion of the gases due to further cracking reactions may occur above cone 58, the majority of acceleration due to hydrocarbon heating and reaction has occurred before the feed and catalyst mixture exits the acceleration zone. Therefore, any additional increase in velocity of the feed and catalyst mixture downstream of the cone 58 will not introduce significant turbulence into the flowing mixture.

What is claimed is:

1. A method of mixing fluidized particles with a fluid feed stream comprising hydrocarbons, said method comprising:

a) combining fluidized particles and a fluidizing medium in an upstream section of a conduit to produce a dense bed of catalyst;

b) passing said dense bed of catalyst downstream through said conduit into a feed contact zone having a reduced cross sectional area relative to said upstream section;

c) discharging a fluid feed stream radially into said feed contact zone to produce a mixture of feed and catalyst;

d) accelerating said mixture of feed and catalyst in a downstream direction in said conduit through an acceleration zone, said acceleration zone having a continuously increasing cross sectional area;

e) maintaining a residence time of at least 0.05 seconds for said mixture of feed and catalyst in said acceleration zone; and, f) passing said mixture of feed and catalyst from said acceleration zone into a section of said conduit having a uniform cross sectional area.

2. The process of claim 1 wherein said conduit is a vertically oriented riser conduit and said dense bed is formed in a lower section of said conduit.

3. The process of claim 2 wherein said fluidizing gas passes through said dense bed at a velocity of from 3.0 to 5.0 ft/sec.

4. The process of claim 1 wherein said feed contact zone has an annular cross section.

5. The process of claim 2 wherein the maximum transverse width across the annulus of said feed contact zone is 6 inches.

6. The process of claim 1 wherein the catalyst density in said dense bed is greater than 20 lb/ft$^3$.

7. The process of claim 4 wherein said fluid feed stream is discharged from into said annular opening from both transverse sides of said opening.

8. The process of claim 1 wherein said mixture of feed and catalyst mixture exits said acceleration zone at a velocity of at least 40 ft/sec.

9. A method of mixing fluidized catalyst particles with a feed stream comprising liquid hydrocarbons, said method comprising:

a) combining fluidized particles and a fluidizing medium in an upstream section of a vertically extending riser conduit to produce a dense bed of catalyst having a density of at least 20 lb/ft$^3$;

b) passing said fluidizing gas upwardly through said dense bed of catalyst at a velocity of 1.0 to 3.0 ft/sec and passing catalyst into an annular feed contact zone having a maximum annulus width of 6 inches;

c) discharging a feed stream comprising liquid hydrocarbons radially into said feed contact zone to produce a mixture of feed and catalyst;

d) accelerating said mixture of feed and catalyst upwardly through an acceleration zone at a velocity of at least 40 ft/sec, said acceleration zone having a uniformly increasing cross sectional area;

e) maintaining a residence time of at least 0.05 seconds for said mixture of feed and catalyst in said acceleration zone; and, f) passing said mixture of feed and catalyst from said acceleration zone at a velocity of at least 40 ft/sec into a section of said riser having a uniform cross sectional area.

10. The process of claim 9 wherein said fluid feed stream is discharged into said annular opening from both sides of said annular opening.

11. The process of claim 9 wherein said feed stream is radially discharged into said catalyst at a velocity of at least 6 ft/sec.

12. The process of claim 9 wherein said fluidizing medium comprises steam.

* * * * *